US006692330B1

(12) United States Patent
Kulick

(10) Patent No.: US 6,692,330 B1
(45) Date of Patent: Feb. 17, 2004

(54) INFANT TOY

(76) Inventor: David Kulick, 14 Coach La., Upper Saddle River, NJ (US) 07458

( * ) Notice: Subject to any disclaimer, the term of this patent is extended or adjusted under 35 U.S.C. 154(b) by 79 days.

(21) Appl. No.: 10/192,412

(22) Filed: Jul. 10, 2002

(51) Int. Cl.[7] ..... A63H 3/28

(52) U.S. Cl. ..... 446/297; 446/302; 434/308; 434/320

(58) Field of Search ..... 446/142, 227, 446/297, 299, 302, 318, 397, 416, 143; 434/157, 169, 308, 309, 319, 320, 393

(56) References Cited

U.S. PATENT DOCUMENTS

| | | | | | |
|---|---|---|---|---|---|
| 4,973,286 | A | | 11/1990 | Davison | |
| 5,027,457 | A | | 7/1991 | Sweet | |
| 5,114,376 | A | * | 5/1992 | Copley et al. | 446/369 |
| 5,279,514 | A | * | 1/1994 | Lacombe et al. | 446/297 |
| 5,468,172 | A | | 11/1995 | Basile | |
| 5,474,484 | A | * | 12/1995 | Lemelle | 446/142 |
| 5,738,526 | A | * | 4/1998 | Cerda et al. | 434/304 |
| 5,813,065 | A | | 9/1998 | Tinhorn | |
| 6,000,987 | A | | 12/1999 | Belin et al. | |
| 6,029,042 | A | * | 2/2000 | Yaron-Moallim | 434/309 |
| 6,101,366 | A | * | 8/2000 | Castillo | 434/308 |
| 6,116,983 | A | | 9/2000 | Long et al. | |
| 6,142,963 | A | | 11/2000 | Black et al. | |
| 6,170,602 | B1 | | 1/2001 | Mann | |
| 6,179,682 | B1 | * | 1/2001 | Plain et al. | 446/141 |
| 6,394,872 | B1 | * | 5/2002 | Watanabe et al. | 446/175 |

OTHER PUBLICATIONS

Webpage from www.onestepahead.com, viewed on Jul. 8, 2002, showing a MUSICAL SLEEP, SLEEP AND AWAY infant toy.

Webpage from www.onestepahead.com, viewed on Jul. 8, 2002, showing a Natures Lullaby Player infant toy.

Webpage from www.eoutletcenter.com, viewed on Jul. 8, 2002, showing an electronic toy.

Webpage from www.smartkids.com, viewed on Jul. 8, 2002, showing a voice activated mobile.

Webpage from www.babyant.com, viewed on Jul. 9, 2002, showing a baby seat.

* cited by examiner

*Primary Examiner*—Derris H. Banks
*Assistant Examiner*—Bena B. Miller
(74) *Attorney, Agent, or Firm*—Rankin, Hill, Porter & Clark LLP

(57) ABSTRACT

An infant toy includes a body portion having an interior cavity within which an audio device is disposed. The body portion has a soft exterior surface. The audio device has "play" and "record" functions, both of which may be activated manually or by voice. The audio device has the capability of playing pre-recorded sounds such as soothing music, user-recorded sounds such as the parent' voices, or a combination of pre-recorded sounds and user-recorded sounds. The toy can cease operation after a predetermined period of time. By setting the toy in the voice-activated mode, the toy can comfort an infant when necessary and turn itself off after the infant has fallen asleep.

9 Claims, 2 Drawing Sheets

INFANT TOY

BACKGROUND OF THE INVENTION

1. Field of the Invention

The invention relates generally to infant toys and, more particularly, to a toy especially adapted to sooth an infant in a crib environment.

2. Description of the Prior Art

Many toys have been developed for the comfort and entertainment of infants and small children. Stuffed animals have always remained popular, both for their appeal with children of all ages, and for safety reasons. As technology has advanced, it has become possible to merge modern technology with traditional toys. For many years, infants have been amused and soothed by toys which produce sound. In recent years, more toys have incorporated voice-activation technology, where the toy is operated by the child's voice. There is ample prior art in the field of sound-producing toys where the sound is pre-recorded.

Davison (U.S. Pat. No. 4,973,286) discloses a multiple activation crib toy. The crib toy has means for being affixed to the side of a crib. The toy has a housing formed from a molded plastic material, with an interior cavity and a stage portion, figures movably supported upon the stage portion, music means inside the interior cavity, motion means for moving the figures, and sound detecting means for activating the toy. When sound is detected, music plays and the figures move upon the stage.

Sweet (U.S. Pat. No. 5,027,457) discloses a pillow with appendages, and a cover for a pillow with appendages. The pillow has extended arms and legs, where the arms are long enough to extend around the neck or torso of a human. The pillow or pillow cover may be decorated, so that the pillow can be ornamental, or resemble a caricature of a person or animal. The pillow is formed so that it may cling to a human body. The pillow may include means of emitting sound, such as a pull string or voice-activated tape player. Means may also be included to enable one or more of the pillow's appendages to move.

Belin et al. (U.S. Pat. No. 6,000,987) discloses a doll or animal with replaceable voice-activated speaking and recording mechanism. The mechanism may be inside the doll or animal, or it may be in a backpack. The mechanism has an audio device having a recorder to record sounds and a player to play the sounds recorded. A tape player is also provided for playing prerecorded messages, stories, or songs. The recorder may be voice-activated, so that the doll can record a child's voice when the child begins to play with the doll. The playing function of the tape player is not voice-activated.

Other references that disclose dolls, toys, or other objects such as pillows that play music or other sounds include the patents to Basile (U.S. Pat. No. 5,468,172); Tinhorn (U.S. Pat. No. 5,813,065); Long et al. (U.S. Pat. No. 6,116,983); Black et al. (U.S. Pat. No. 6,142,963); and Mann (U.S. Pat. No. 6,170,602). Applicant incorporates by reference herein the disclosure of each of the patents referred to above.

Despite the teachings of the prior art, there remains a need for an improved infant toy. Desirably, such an infant toy would be equipped to record and play parent' recorded voices or other sounds in order to provide comfort to the infant.

Preferably, any such toy would have the capability to play the recording upon voice-activation. Additionally, any such infant toy would have the capability to play pre-recorded sounds, user-recorded sounds, or a combination of pre-recorded sounds and user-recorded sounds.

SUMMARY OF THE INVENTION

In response to the foregoing concerns, the present invention provides an infant toy especially adapted for use in a crib environment. The infant toy is comprised of a body portion having an internal cavity and an audio device disposed within the cavity. The body portion is similar to commercially available stuffed animals and dolls, having a soft exterior manufactured from textiles, and having a high degree of cushioning. The audio device is disposed within the cavity and includes an audio memory that contains pre-recorded sounds, a sound recorder that initially contains no pre-recorded sounds but which can record sounds supplied by a user, a microphone connected to the sound recorder, a player to play sounds contained in either the audio memory or-the sound recorder or both, a speaker to broadcast sounds being played by the player, a manual or voice-activated first control for the player, a manual or voice-activated second control for the recorder, a manual third control for the audio memory and sound recorder, and a time-delay shut-off mechanism.

As will be apparent from the foregoing summary, the audio device has "play" and "record" functions, both of which may be activated manually or by voice. The audio device has the capability of playing pre-recorded sounds, user-recorded sounds, or a combination of pre-recorded sounds and user-recorded sounds. Thus, the toy may be placed in close proximity to an infant, and when the infant cries, the toy will play a predetermined selection of sounds intended to soothe the infant.

The foregoing and other features and advantages of the invention will be apparent from an examination of the specification and claims that follow, including the accompanying drawings.

DESCRIPTION OF THE PREFERRED EMBODIMENT

Figure 1:
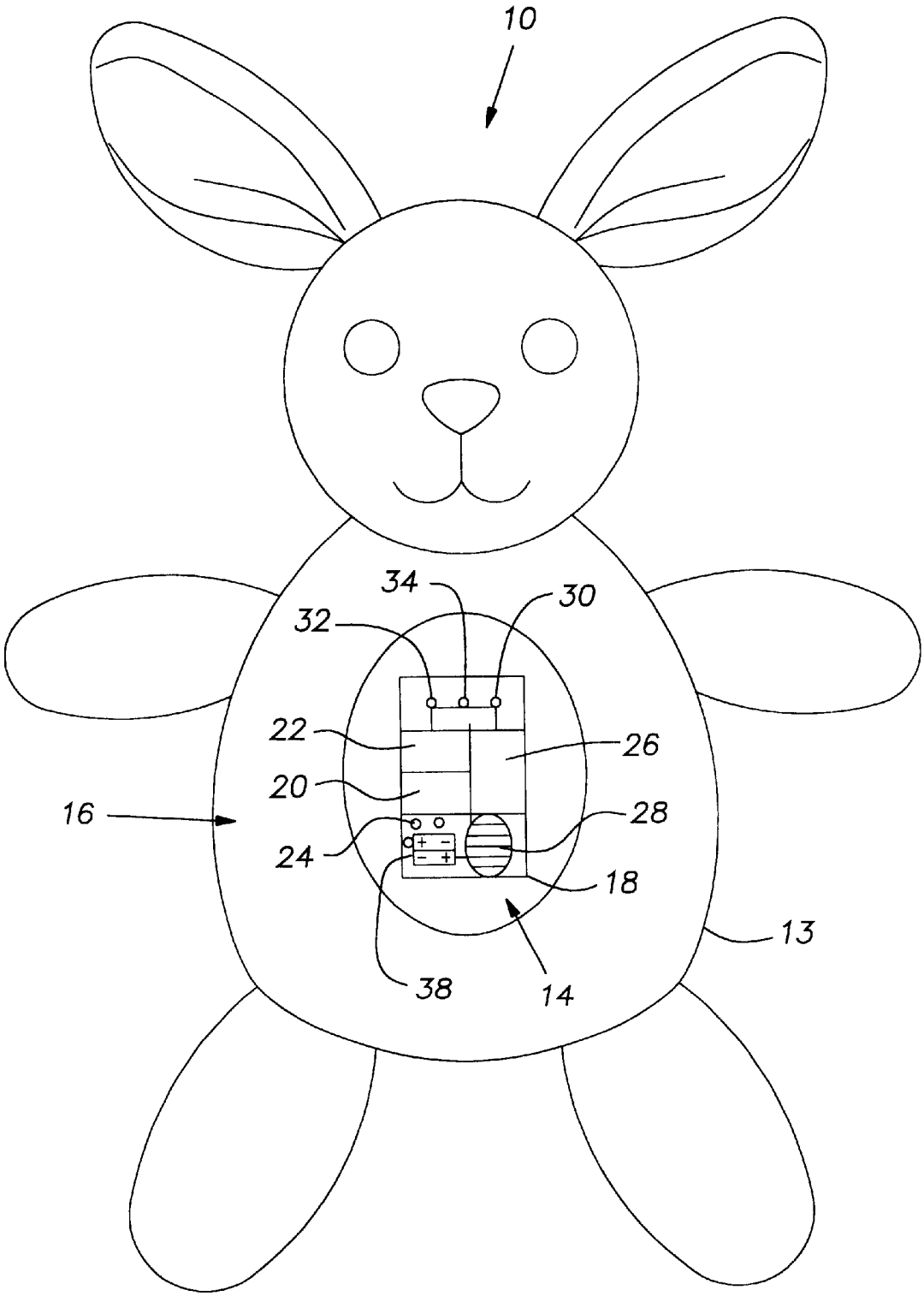
FIG. 1 is a front elevation view of the infant toy of the present invention showing an audio device disposed within an interior cavity.
Figure 2:
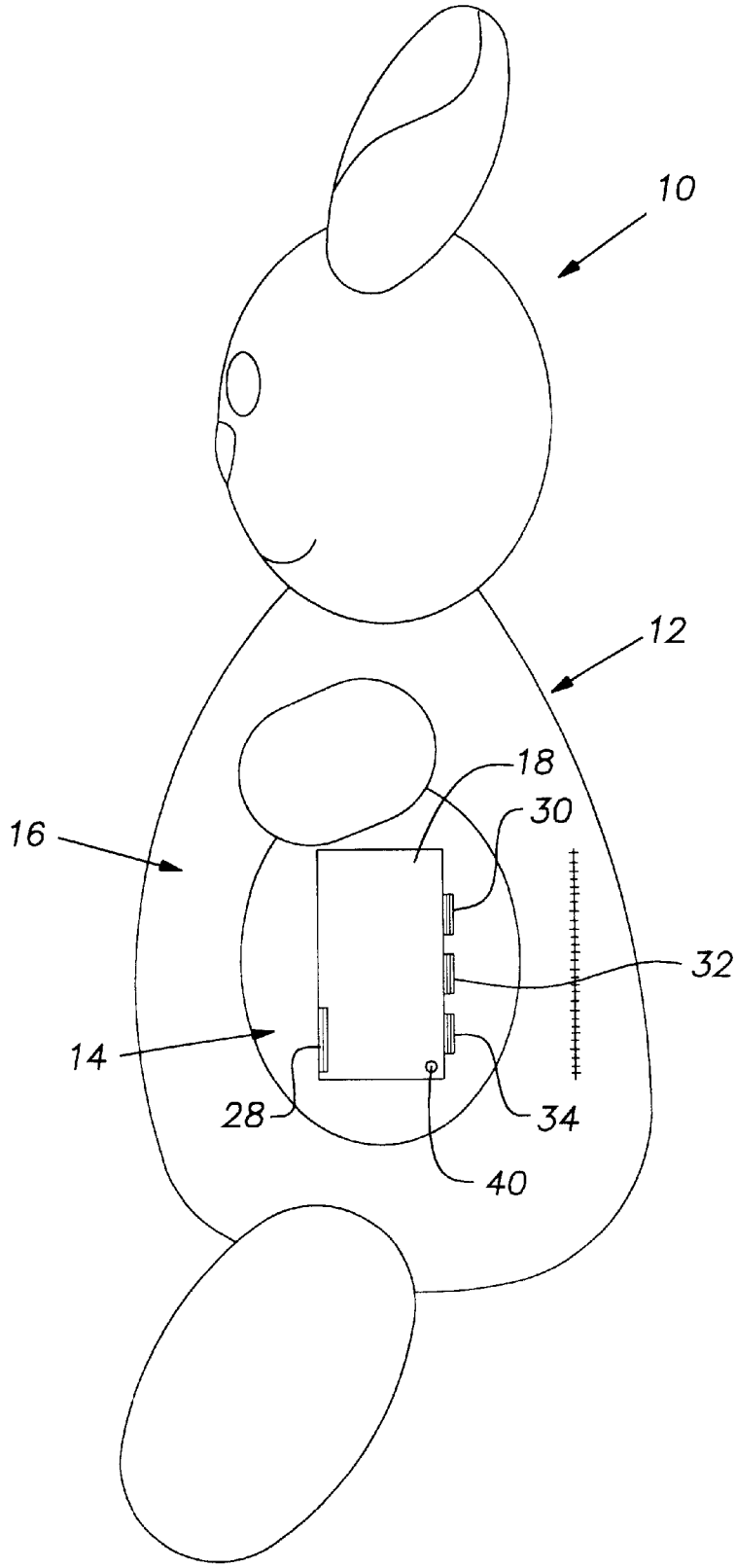
FIG. 2 is a side elevation view, partly in cross-section, of the infant toy of the present invention.

An infant toy according to the present invention is indicated in FIGS. 1 and 2 by the reference numeral 10. The infant toy 10 comprises a body portion 12 having a soft exterior surface 13 similar to the plush surfaces of commercially available stuffed toys. The body portion 12 comprises an interior cavity 14 defined by a wall 16. The wall 16 and the exterior surface 13 preferably are sound-permeable, and preferably are formed from a textile. Examples of suitable textiles include faux fur, cloth, and filling, such as polyester filling, although other suitable materials may be employed. The exterior surface 13 may resemble, for example, an animal, person, or other character, but is not limited to these forms. The infant toy 10 preferably includes an amount of textile sufficient to provide a cushioning effect. The cushioning effect is a desirable characteristic in toys for safety reasons and for aesthetic appeal.

An audio device 18 is disposed within the interior cavity 14 of the infant toy 10. The audio device 18 includes an audio memory 20. The audio memory 20 may utilize digital memory means or analog memory means, however, other memory means may be used. The audio memory 20 preferably contains pre-recorded sounds, and more preferably, pre-recorded sounds intended to soothe an infant. Examples of such soothing sounds include music and nature sounds.

The audio device 18 further includes a sound recorder 22 that initially does not contain pre-recorded sounds. A microphone 24 is electrically connected to the sound recorder 22 and is preferably adjacent the sound-permeable wall 16 to ensure the optimum performance of the microphone 24. The microphone 24 enables the sound recorder 22 to record sounds, and acts as a vessel through which sound travels to the sound recorder 22. The microphone 24 may be a commercially available microphone, of which many suitable varieties exist.

The audio device 18 further includes a player 26. The player 26 plays sounds contained in the audio memory 20, the sound recorder 22, or both. The sound recorder 22 records sounds to the audio memory 20. Examples of such sounds include music and voices, which may be played back at a later time, either alone or along with the pre-recorded sounds contained in the audio memory 20.

The audio device 18 further includes a speaker 28 connected to the player 26. The speaker 28 broadcasts sounds played by the player 26. The speaker 28 preferably is adjacent the sound-permeable wall 16 to facilitate the transmission of sound.

The audio device 18 further includes several controls to activate and deactivate the infant toy 10. A first control 30 is in electrical communication with the player 26. The first control 30 regulates the operation of the player 26, and may be activated manually or by voice. A second control 32 is in electrical communication with the sound recorder 22. The second control 32 regulates the operation of the sound recorder 22, and may also be activated manually or by voice. A third control 34 is in electrical communication with the audio memory 20 and the sound recorder 22. The third control 34 is activated manually, and permits playback of either the audio memory 20 or the sound recorder 22, or both the audio memory 20 and the sound recorder 22, or the control 34 may deactivate the infant toy 10 and permit the activation of neither the audio memory 20 nor the sound recorder 22.

The audio device 18 further includes a time-delay shut-off mechanism 36 that is in electrical communication with the player 26. The shut-off mechanism 36 causes the player 26 to cease operation after a predetermined period of time. The period of time is determined in accordance with commencement of voice-activation of either the audio memory 20 or the sound recorder 22, or both the audio memory 20 and the sound recorder 22.

The infant toy 10 further comprises a power source 38 disposed within the interior cavity 14. The power source 38 is portable, and is connected to the components of the audio device 18. The power source 38 may be in the form of batteries to supply power to the infant toy 10, and may also have an AC adapter 40 and recharging means. The portable power source 38 allows the infant toy 10 to be readily transported. The AC adapter 40 would allow the infant toy 10 to be plugged into an electrical outlet for operation of the infant toy 10, or for the batteries 38 to be recharged without removing the batteries 38 from the infant toy 10.

The audio device 18 is capable of playing music, voices, or combinations thereof, including pre-recorded sounds, user-recorded sounds such as voices or music, and pre-recorded sounds in combination with user-recorded sounds. Additionally, the audio device 18 is capable of playing nature sounds or white noise, either pre-recorded or user-recorded. Examples of nature sounds include the sounds of rain, wind, and the ocean.

Although the invention has been described in its preferred form with a certain degree of particularity, it will be understood that the present disclosure of the preferred embodiment has been made only by way of example, and that various changes may be resorted to without departing from the true spirit and scope of the invention as hereinafter claimed. It is intended that the patent shall cover, by suitable expression in the appended claims, whatever degree of patentable novelty exists in the invention disclosed.

What is claimed is:

1. An infant toy especially adapted for soothing an infant, comprising:

a body portion having a soft exterior surface;

an interior cavity within the body portion defined by walls, at least one of which is sound-permeable; and an audio device disposed within the cavity, the audio device including:

an audio memory that contains pre-recorded sounds intended to sooth an infant;

a sound recorder that initially contains no pre-recorded sounds but which can record sounds supplied by a user;

a microphone electrically connected to the sound recorder, the microphone being disposed adjacent the sound-permeable wall;

a player to play sounds contained in either the audio memory or the sound recorder or both;

a speaker to broadcast sounds being played by the player, the speaker being disposed adjacent the sound-permeable wall;

a first control in electrical communication with the player to control operation thereof, the first control being activated manually or by voice-activation;

a second control in electrical communication with the recorder to control operation thereof, the second control being activated manually or by voice-activation;

a third control in electrical communication with the audio memory and the sound recorder, the third control being activated manually to permit playback of the contents of either the audio memory or the sound recorder, or both the audio memory and the sound recorder, or neither the audio memory or the sound recorder; and a time-delay shut-off mechanism in electrical communication with the player, the shut-off mechanism causing the player to cease operation after the passage of a predetermined period of time.

2. The toy of claim 1, wherein the shut-off mechanism causes the player to cease operation after the passage of a predetermined period of time subsequent to commencement of voice-activation of either the audio memory or the sound recorder or both the audio memory and the sound recorder.

3. The toy of claim 1, further comprising a portable electrical power source disposed within the cavity.

4. The toy of claim 1, wherein the pre-recorded sounds are music.

5. The toy of claim 1, wherein the toy is in the form of a plush animal.

6. The toy of claim 1, wherein the toy is in the form of a doll.

7. A method for soothing an infant, comprising the steps of: providing a toy having:

a body portion with a soft exterior surface;

an interior cavity within the body portion defined by walls, at least one of which is sound-permeable; and an audio device disposed within the cavity, the audio device including:

an audio memory that contains pre-recorded sounds intended to soothe an infant;

a sound recorder that initially contains no pre-recorded sounds but which can record sounds supplied by a user;

a microphone electrically connected to the sound recorder, the microphone being disposed adjacent the sound-permeable wall;

a player to play sounds contained in either the audio memory or the sound recorder or both;

a speaker to broadcast sounds being played by the player, the speaker being disposed adjacent the sound-permeable wall;

a first control in electrical communication with the player to control operation thereof, the first control being activated manually or by voice-activation;

a second control in electrical communication with the recorder to control operation thereof, the second control being activated manually or by voice-activation;

a third control in electrical communication with the audio memory and the sound recorder, the third control being activated manually to permit playback of the contents of either the audio memory or the sound recorder, or both the audio memory and the sound recorder, or neither the audio memory or the sound recorder; and a time-delay shut-off mechanism in electrical communication with the player, the shut-off mechanism causing the player to cease operation after the passage of a predetermined period of time subsequent to commencement of voice-activation of either the audio memory or the sound recorder or both the audio memory and the sound recorder;

recording infant-soothing sounds into the sound recorder; placing the toy near an infant; and activating the player to play sounds from either the audio memory or the sound recorder, or both the audio memory and the sound recorder.

8. The method of claim 7, wherein the step of activating the player is performed manually or by voice-activation.

9. The method of claim 8, wherein the step of activating the player is stopped after a predetermined period of time.

* * * * *